US011965703B2

(12) United States Patent
Yang

(10) Patent No.: US 11,965,703 B2
(45) Date of Patent: Apr. 23, 2024

(54) HEAT EXCHANGER END COVER INTEGRATED WITH RUBBER BALL CLEANING APPARATUS

(71) Applicant: GUANGZHOU MARTON ENVIRONMENTAL TECHNOLOGY CO., LTD., Guangdong (CN)

(72) Inventor: Jian Yang, Guangzhou (CN)

(73) Assignee: GUANGZHOU MARTON ENVIRONMENTAL TECHNOLOGY CO., LTD., Guangdong (CN)

( * ) Notice: Subject to any disclaimer, the term of this patent is extended or adjusted under 35 U.S.C. 154(b) by 339 days.

(21) Appl. No.: 17/260,987

(22) PCT Filed: Jul. 19, 2019

(86) PCT No.: PCT/CN2019/096714
§ 371 (c)(1),
(2) Date: Jun. 23, 2021

(87) PCT Pub. No.: WO2020/020065
PCT Pub. Date: Jan. 30, 2020

(65) Prior Publication Data

US 2021/0396482 A1 Dec. 23, 2021

(30) Foreign Application Priority Data

Jul. 27, 2018 (CN) ..... 201810852967.0

(51) Int. Cl.
*F28G 1/12* (2006.01)
*F28F 9/02* (2006.01)
*F28G 15/00* (2006.01)

(52) U.S. Cl.
CPC ..... *F28G 1/12* (2013.01); *F28F 9/02* (2013.01); *F28G 15/00* (2013.01); *F28G 2015/006* (2013.01)

(58) Field of Classification Search
CPC ..... F28G 1/12; F28G 15/00; F28G 2015/006; F28G 1/00; F28F 9/02; B08B 9/057
See application file for complete search history.

(56) References Cited

U.S. PATENT DOCUMENTS 3,215,195 A * 11/1965 Treplin ..... F28G 1/12 165/95
4,420,038 A * 12/1983 Okouchi ..... F28G 1/12 165/95

(Continued)

FOREIGN PATENT DOCUMENTS

CA 2748987 A1 * 10/2010 ..... B08B 9/055
CN 1222967 A * 7/1999 ..... F28G 1/12

(Continued)

OTHER PUBLICATIONS

Cui Keqing, editor in chief. "Dictionary Of Safety Engineering." Nov. 1995. Chemical Industry Press. Beijing, China.

(Continued)

*Primary Examiner* — Jenna M Maroney
(74) *Attorney, Agent, or Firm* — WEITZMAN LAW OFFICES, LLC

(57) ABSTRACT

A heat exchanger end cover integrated with a rubber ball cleaning apparatus is disclosed, including a ball collector and a booster pump which are arranged outside the heat exchanger end cover, and a ball-receiving filter screen arranged inside the heat exchanger end cover. The heat exchanger end cover is connected to a cooling water inlet pipe joint and a cooling water outlet pipe joint, the cooling water inlet pipe joint is provided with a water suction port and a ball-dispensing port, and the cooling water outlet pipe joint is provided with a water discharge port and a ball-receiving port.

4 Claims, 4 Drawing Sheets

(56) References Cited

U.S. PATENT DOCUMENTS

| | | | | | |
|---|---|---|---|---|---|
| 4,556,102 | A | * | 12/1985 | Bochinski | F28G 1/12 165/95 |
| 5,592,990 | A | * | 1/1997 | Ben-Dosa | F28G 1/12 165/95 |
| 7,975,758 | B2 | * | 7/2011 | Ho | F28G 1/12 15/21.2 |
| 8,646,514 | B2 | * | 2/2014 | Ni | F28B 1/02 15/104.062 |
| 8,943,633 | B2 | * | 2/2015 | Soh | B08B 9/0551 165/95 |
| 10,816,284 | B2 | * | 10/2020 | Jackson | F28G 1/12 |
| 2011/0168353 | A1 | | 7/2011 | Ni | |

FOREIGN PATENT DOCUMENTS

| | | | | | |
|---|---|---|---|---|---|
| CN | 201129969 | Y | | 10/2008 | |
| CN | 101691980 | B | | 12/2011 | |
| CN | 102679806 | A | | 9/2012 | |
| CN | 202747899 | U | * | 2/2013 | |
| CN | 202938691 | U | | 5/2013 | |
| CN | 203615821 | U | * | 5/2014 | |
| CN | 104807368 | A | * | 7/2015 | |
| CN | 204594317 | U | | 8/2015 | |
| CN | 104896993 | A | * | 9/2015 | |
| CN | 104896993 | A | | 3/2017 | |
| CN | 106568240 | A | * | 4/2017 | |
| CN | 106931824 | A | * | 7/2017 | F28G 1/12 |
| CN | 108871045 | A | | 11/2018 | |
| CN | 208805095 | U | | 4/2019 | |
| CN | 110440631 | A | * | 11/2019 | |
| CN | 110470170 | A | * | 11/2019 | |
| CN | 113804041 | A | * | 12/2021 | |
| CN | 216385261 | U | * | 4/2022 | |
| CN | 217785951 | U | * | 11/2022 | |
| JP | H05296687 | A | * | 11/1993 | |
| JP | 2006003007 | A | | 5/2006 | |
| JP | 2017090036 | A | * | 5/2017 | B01D 35/02 |
| KR | 101557135 | B1 | * | 10/2015 | |
| KR | 20180060255 | A | * | 6/2018 | |
| KR | 20170127655 | A | * | 4/2019 | |
| WO | WO-02055174 | A1 | * | 7/2002 | B01D 29/356 |
| WO | 2010114479 | A1 | | 10/2010 | |
| WO | WO-2020020065 | A1 | * | 1/2020 | |
| WO | WO-2021051414 | A1 | * | 3/2021 | |

OTHER PUBLICATIONS

Liu Dongning. "Research and industrial application of cooling exchanger rubber ball online cleaning technology." Jan. 2006. Petro-Chemical Equipment, vol. 35, No. 1, pp. 64-67. Lanzhou Petroleum Machinery Research Institute Co., Ltd., Lanzhou, China.

Guangzhou Intellectual Property Court. "Paper of Civil Judgment." Jul. 21, 2021. Case No. (2021)Yue 73 Zhiminchu No. 99. Guangzhou, China.

The Supreme People's Court of The People's Republic of China. "Paper of Civil Judgment." Apr. 18, 2022. Case No. (2021) Zuigaofazhiminzhong No. 2091. Beijing, China.

Indian Patent Office. "First Examination Report." dated Dec. 30, 2021.

European Patent Office. "Extended European Search Report." dated Mar. 2, 2022.

* cited by examiner

HEAT EXCHANGER END COVER INTEGRATED WITH RUBBER BALL CLEANING APPARATUS

CROSS-REFERENCE TO RELATED APPLICATIONS

This application is a national stage tiling under 35 U.S.C. § 371 of international application No. PCT/CN2019/096714, filed Jul. 19, 2019, which claims priority to Chinese patent application No. 201810852967.0 filed Jul. 27, 2018. The contents of these applications are incorporated herein by reference in their entirety.

TECHNICAL FIELD

The present disclosure relates to the technical field of heat exchangers, and in particular to a heat exchanger end cover integrated with a rubber ball cleaning apparatus.

BACKGROUND

At present, in order to enable rubber balls in a heat exchanger cleaning apparatus to be circularly dispensed and received under the power of water pressure, a water suction port and a ball-dispensing port are generally spaced by a long distance, so that the pressure at the water suction port is higher than that at the ball-dispensing port, ensuring that the rubber balls can be smoothly dispensed out from the ball collector. For example, in Patent Application Publication No. CN104896993A, the difference between the dynamic pressure and static pressure of fluid is utilized as a driving force to recover and inject rubber balls, and in order to obtain a large pressure difference, the water suction port and the ball-dispensing port need to be spaced by a certain distance to meet the required pressure difference. Therefore, the heat exchanger cleaning apparatus can only be arranged on a cooling water inlet pipe and a cooling water outlet pipe which are connected to a heat exchanger end cover. This causes the heat exchanger cleaning apparatus to occupy a large installation space, which, on one hand, reduces the installation adaptability of the whole apparatus, and on the other hand, does not facilitate the saving and full utilization of the space.

SUMMARY

In order to solve the technical problem mentioned above, the present disclosure provides a heat exchanger end cover integrated with a rubber ball cleaning apparatus which can reduce the space occupied by the apparatus.

The technical theme adopted to solve the aforementioned technical problem is described as follows. There is provided a heat exchanger end cover integrated with a rubber ball cleaning apparatus including a ball collector and a booster pump which are arranged outside the heat exchanger end cover, and a ball-receiving filter screen arranged inside the heat exchanger end cover. A cooling water inlet pipe joint and a cooling water outlet pipe joint are connected to the heat exchanger end cover, the cooling water inlet pipe joint is provided with a water suction port and a ball-dispensing port and the cooling water outlet pipe joint is provided with a water discharge port and a ball-receiving port. Both ends of the ball collector are respectively provided with an upper port and a lower port, a screen is arranged in the middle of an interior of the ball collector, and rubber balls are placed between the screen and the upper port. The lower port is divided into two parts to form a first pipeline communicating with the water suction port and a second pipeline communicating with the water discharge port, the first pipeline is provided with a three-way valve A having two water inlets communicated with the first pipeline, and the second pipeline is provided with a three-way valve B having two water inlets communicated with the second pipeline, the booster pump is connected between water outlets of the three-way valve A and the three-way valve B. The upper port is divided into two parts to form a third pipeline and a fourth pipeline, the third pipeline is provided with a one-way valve A and passes through the hail-dispensing port to extend into the cooling water inlet pipe joint, and the fourth pipeline is provided with a one-way valve B and passes through the ball-receiving port to extend into the cooling water outlet pipe joint to be communicated with the ball-receiving filter screen.

In some embodiments, the ball collector is transversely arranged in a gap formed by the cooling water inlet pipe joint and the cooling water outlet pipe joint, and both the upper port and the lower port point to a radial direction of the heat exchanger end cover.

In some embodiments, the booster pump and the ball collector are closely arranged side by side.

In some embodiments, sections of the pipelines provided with the one-way valve A and the one-way valve B are horizontally arranged.

In some embodiments, both the three-way valve to and the three-way valve B are three-way electric valves.

The present disclosure has the following beneficial effects. Because the rubber ball cleaning apparatus is integrated with the heat exchanger end cover and integrally installed with the heat exchanger end cover, on one hand, the overall dimension of the whole apparatus is greatly reduced, and the requirement for the installation dimension of the apparatus is decreased, and on the other hand, the installation complexity of the whole apparatus is decreased. Moreover, by incorporating the booster pump in the rubber ball cleaning apparatus, the pressure in the rubber ball circulation loop in the whole rubber ball cleaning apparatus is effectively increased, and the disadvantage that the water suction port and the ball-dispensing port need to be spaced by a long distance in the related technology is solved. In the present disclosure, since the pressure in the circulation loop is increased by means of the booster pump, arranging the water suction port and the ball-dispensing port on the short cooling; water inlet pipe joint also enables a rapid dispensing and recovery of the rubber balls efficiently, thus greatly reducing the space required by the installation of the rubber ball cleaning apparatus.

BRIEF DESCRIPTION OF THE DRAWINGS

The present disclosure will be further described below with reference to the drawings by way of embodiments, in which.

DETAILED DESCRIPTION

Figure 1:
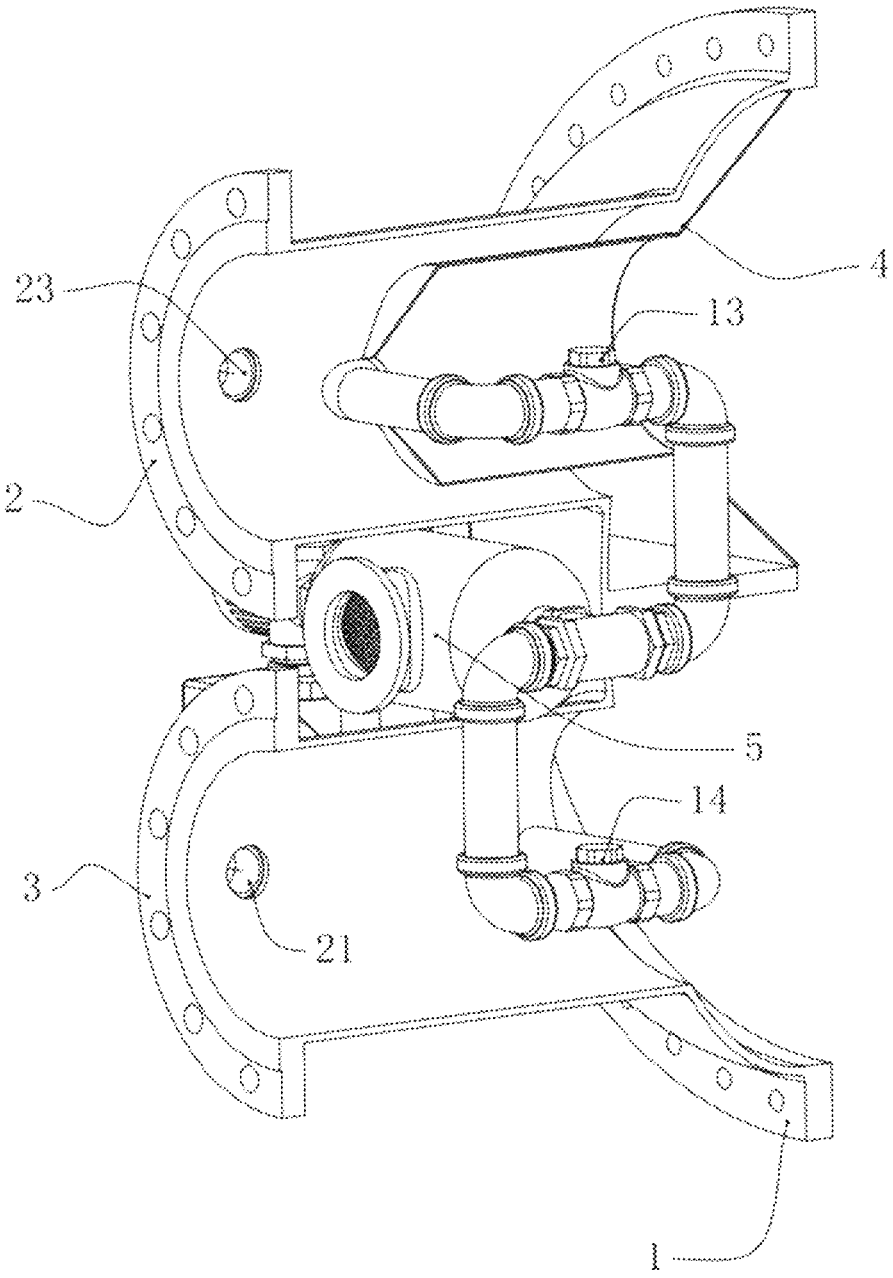
FIG. 1 is a sectional schematic view of a heat exchanger end cover integrated with a rubber ball cleaning apparatus.
Figure 2:
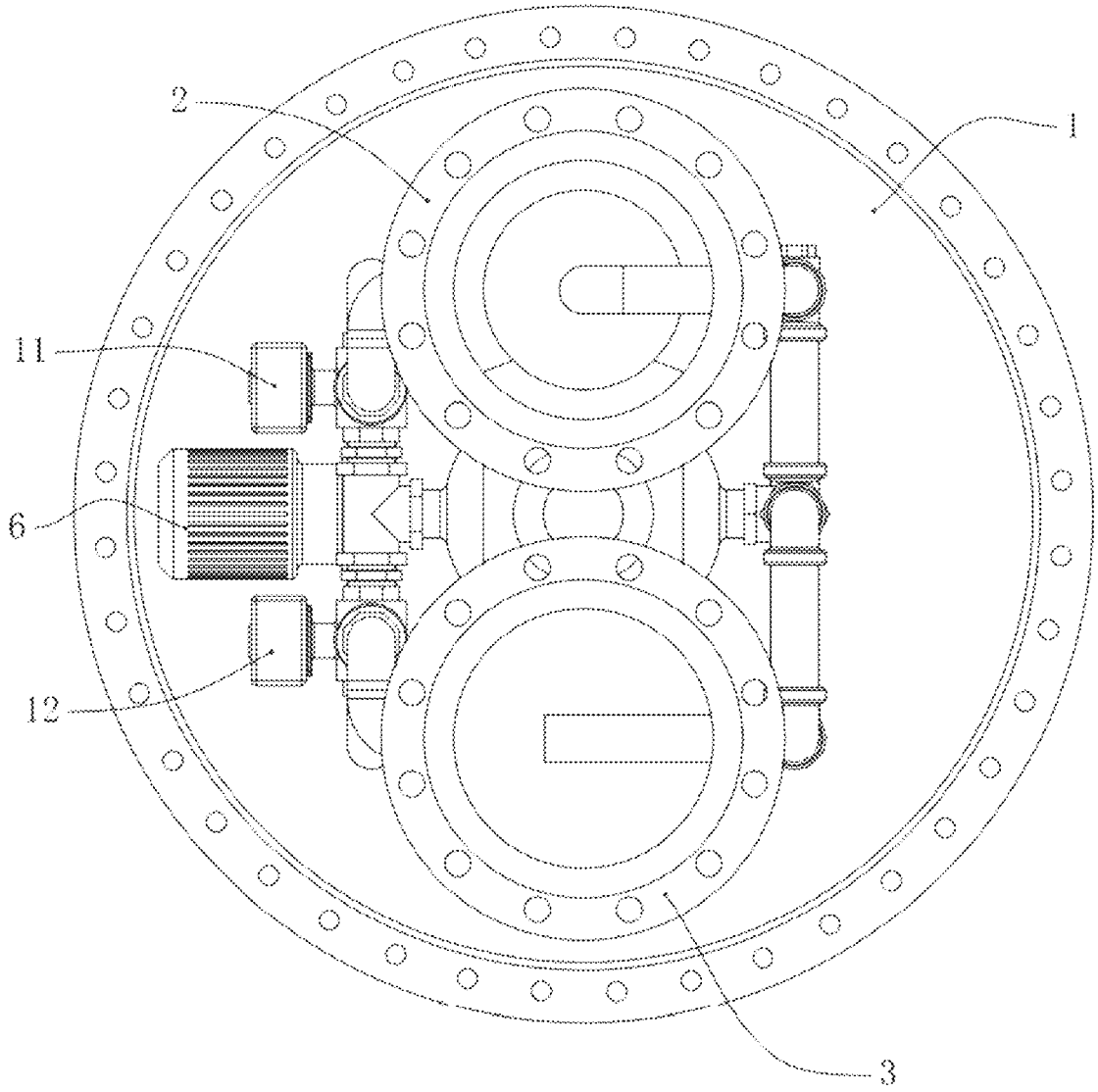
FIG. 2 is a front view of the heat exchanger end cover integrated with the rubber ball cleaning apparatus.
Figure 3:
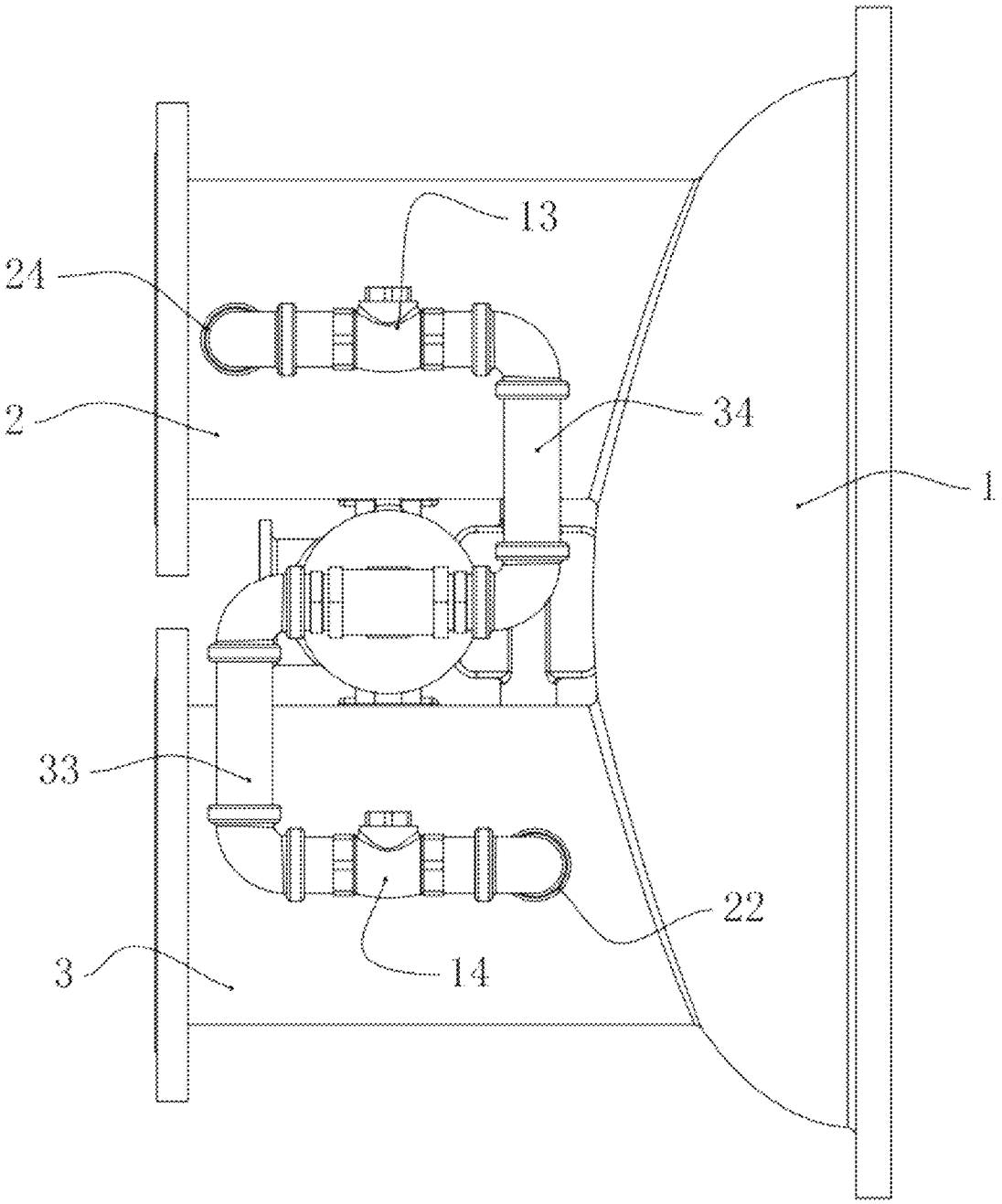
FIG. 3 is a left side schematic view of FIG. 2.

Referring to FIGS. 1-4, a heat exchanger end cover integrated with a rubber ball cleaning apparatus is provided.

A cooling water inlet pipe joint 3 and a cooling water outlet pipe joint 2 are symmetrically arranged outside the heat exchanger end cover 1, with the cooling water inlet pipe joint 3 located at a lower part in the drawings, and the cooling water outlet pipe joint 2 located at an upper part in the drawings. A ball-collecting filter screen 4 is arranged inside the heat exchanger end cover 1.

A ball collector 5 and a booster pump 6 are placed in a gap between the cooling water inlet pipe joint 3 and the cooling water outlet pipe joint 2. Specifically, the ball collector 5 is transversely arranged between the cooling water inlet pipe joint 3 and the cooling water outlet pipe joint 2. An upper port and a lower port of the ball collector 5 both point to a radial direction of the heat exchanger end cover 1. The booster pump 6 and the ball collector 5 are closely arranged side by side, and the booster pump 6 is arranged substantially close to an end of the heat exchanger end cover 1. Moreover, the cooling water inlet pipe joint 3 is provided with a water suction port 21 and a ball-dispensing port 22 which are separated by a short distance in an axial direction of the cooling water inlet pipe joint 3, and the water suction port 21 is located upstream of the cooling water inlet pipe joint 3. Alternatively, the water suction port 21 and the ball-dispensing port 22 are substantially arranged in the same radial plane of the cooling water inlet pipe joint 3, which substantially shortens the distance between the water suction port 21 and the ball-dispensing port 22 and also ensures that the pressure at the water suction port 21 is higher than that at the ball-dispensing port 22. The cooling water outlet pipe joint 2 is provided with a water discharge port 23 and a ball-receiving port 24, which are substantially arranged in the same radial plane of the cooling water outlet pipe joint 2, so that a distance between the water discharge port 23 and the ball-receiving port 24 can also be shortened.

Figure 4:
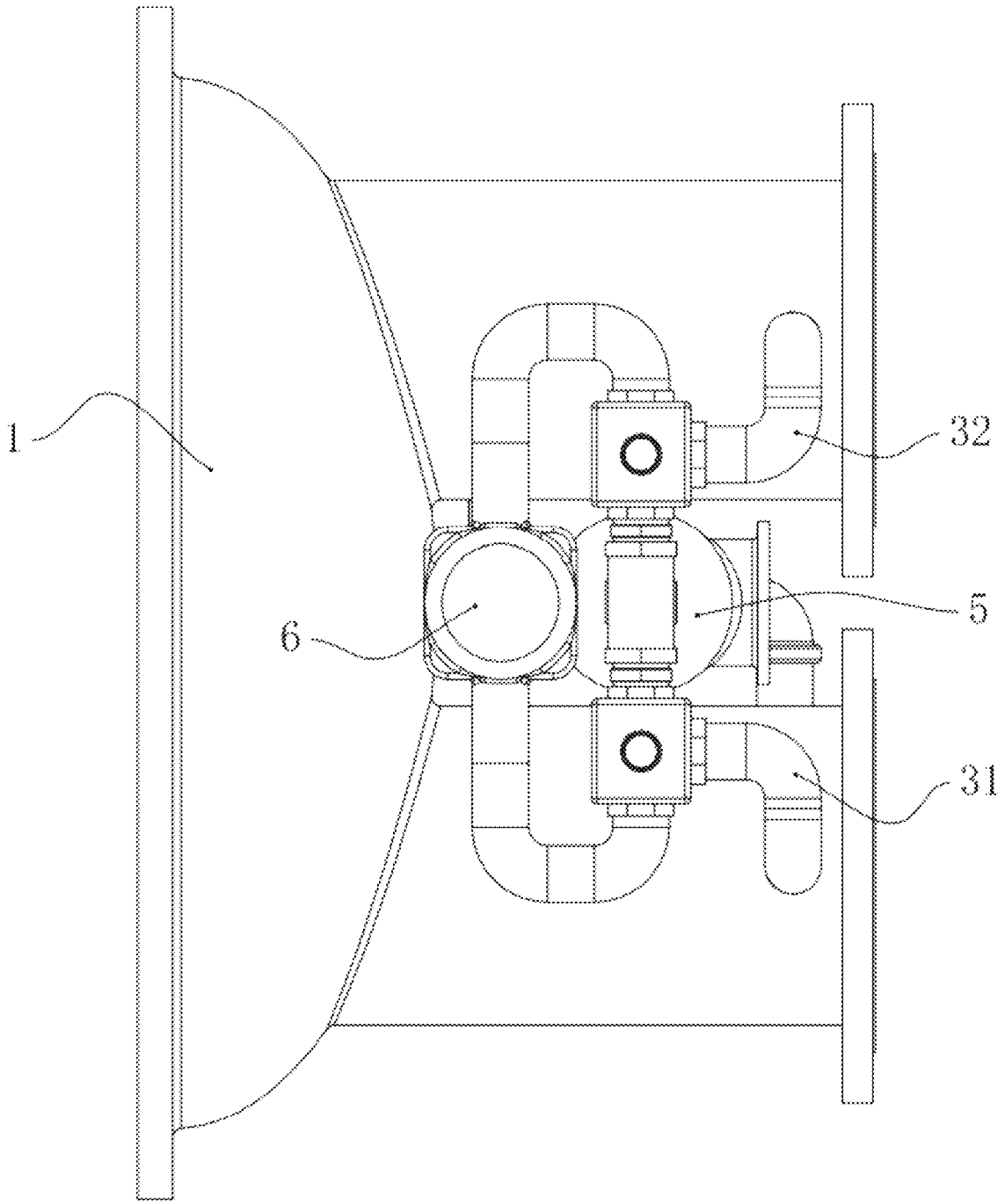
FIG. 4 is a right side schematic view of FIG. 2.

A screen is arranged in the middle of an interior of the ball collector 5, and rubber balls are placed between the screen and the upper port. The lower port of the ball collector 5 is divided into two parts to form a first pipeline 31 communicated with the water suction port 21 and a second pipeline 32 communicated with the water discharge port 23. As shown in FIG. 4, the water suction port 21, the water discharge port 23 and the lower port are located at the same side and they are also located at a first side of the cooling water inlet pipe joint 3 and the cooling water outlet pipe joint 2, which facilitates simplifying the pipelines and reducing the length of the pipelines. The first pipeline 31 is provided with a three-way valve A12 having two water inlets communicated with the first pipeline 31, and the second pipeline 32 is provided with a three-way valve B11 having two water inlets communicated with the second pipeline 32, The booster pump 6 is connected between water outlets of the three-way valve A12 and the three-way valve B11. Specifically, the three-way valve A12 and the three-way valve B11 are both three-way electric valves.

The upper port of the ball collector 5 is divided into two parts to form a third pipeline 33 and a fourth pipeline 34. The third pipeline 33 is provided with a one-way valve A14 and passes through the ball-dispensing port 22 to extend into the cooling water inlet pipe joint 3. The fourth pipeline 34 is provided with a one-way valve B13 and passes through the ball-receiving port 24 to extend into the cooling water outlet pipe joint 2 to be communicated with a ball-receiving filter screen 4. The ball-dispensing port 22, the ball-receiving port 24 and the upper port are located at the same side and they are also located at a second side of the cooling water inlet pope joint 3 and the cooling water outlet pipe joint 2, which also facilitates simplifying the pipelines and reducing the length of the pipelines, wherein the second side is opposite to the first side.

The first pipeline 31, the second pipeline 32, the third pipeline 33 and the fourth pipeline 34 may be fixedly welded on the cooling water inlet pipe joint 3 or the cooling water outlet pipe joint 2, to realize fixed installation of the whole rubber ball cleaning apparatus.

Since the rubber ball cleaning apparatus is integrated in the heat exchanger end cover and integrally installed with the heat exchanger end cover 1, the space of the heat exchanger end cover 1. Is fully utilized, thus on one hand, the overall dimension of the whole apparatus is greatly reduced and the requirement for the installation dimension of the apparatus is decreased, and on the other hand, the installation complexity of the whole apparatus is reduced. Moreover, by incorporating the booster pump 6 in the rubber ball cleaning apparatus, the pressure in the rubber ball circulation loop in the whole rubber ball cleaning apparatus is effectively increased, and the disadvantage that the water suction port 21 and the hall-dispensing port 22 need to be spaced by a long distance in the related technology is solved. In the present disclosure, since the pressure in the circulation loop is increased by means of the booster pump 6, arranging the water suction port 21 and the ball-dispensing port 22 on the short cooling water inlet pipe joint 3 enables a rapid dispensing and recovery of the rubber balls efficiently, thus greatly reducing the space required by the installation of the rubber ball cleaning apparatus.

The operating principle of the rubber ball cleaning apparatus is described as follows.

Ball dispensing process: One of the water inlets of the three-way valve A 12 is controlled to be communicated with the water suction port 21, and the other water inlet is closed, and at the same time, the Water outlet of the three-way valve A 12 communicates with the inlet of the booster pump 6: the water outlet of the three-way valve B 11 is controlled to be communicated with the outlet of the booster pump 6, and at the same time, one of the water inlets of the three-way valve B 11 communicates with the lower port and the other water outlet is closed. Under the action of the booster pump 6, the rubber balls flow out of the ball collector 5, pass through the one-way valve A 14 to be injected into the cooling water inlet pipe joint 3 from the ball-dispensing port 22, and then enter a condenser along with cooling water to clean a copper tube. After cleaning the copper tube, the rubber balls are captured in the ball-receiving filter screen 4, while the cooling water is discharged via the cooling water outlet pipe joint 2. Although the water suction port 21 and the ball-dispensing port 22 arc located on the cooling water inlet pipe joint 3 and are not spaced far apart, the pressure of water flow in the water suction port 21 and the third pipeline 33 is increased under the action of the booster pump 6, which is equivalent to providing a power for driving the cooling water to flow into the cooling water inlet pipe joint 3, so that the rubber balls can smoothly enter the cooling water outlet pipe joint 2 via the ball-dispensing port 22. The disadvantage that a large gap needs to be arranged between the ball-dispensing port 22 and the water suction port 21 for the purpose of providing a great pressure difference so that the pressure at the water suction port 21 is higher than that at the ball-dispensing port 22 is solved, thus solving the problem of saving the installation space.

Ball receiving process: The water outlet of the three-way valve A 12 is controlled to be communicated with the inlet of the booster pump 6, and at the same time, one of the water inlets of the three-way valve A 12 communicates with the lower port, and the other water outlet is closed; one of the water inlets of the three-way valve B 11 is controlled to be communicated with the water discharge port 23, and the other water inlet is closed, and at the same time, the water outlet of the three-way valve B 11 communicates with the outlet of the booster pump 6. Under the action of the booster pump 6, the rubber balls flow out of the ball-receiving filter screen 4, push the one-way valve B 13 open to be recovered into the ball collector 5, and are captured in the ball collector 5 by the screen. Water flows through the screen, and then flows into the cooling water outlet pipe joint 2 via the three-way valve A 12, the booster pump 6 and the three-way valve B 11. Although the ball-receiving port 24 and the water discharge port 23 are located on the cooling water outlet pipe joint 2 and are not spaced far apart or arranged in parallel, under the action of the booster pump 6, the pressure of water flow in the ball-receiving port 24 and the second pipeline 32 is increased, which is equivalent to providing a power for driving the cooling water to flow into the cooling water outlet pipe joint 2, thereby facilitating the circulation of the whole ball receiving process. The disadvantage that a large gap needs to be arranged between the ball-receiving port 24 and the water discharge port 23 for the purpose of providing a great pressure difference so that the pressure at the ball-receiving port 24 is higher than that at the water discharge port 23 is solved, thus solving the problem of saving the installation space.

Moreover, the rubber ball cleaning apparatus has excellent universality, and is composed of common universal parts. In most large and medium-sized refrigeration equipment, the rubber ball cleaning apparatus can be designed and installed as an external accessory, and will not have obvious influence on the end cover of refrigeration equipment. With such a design, the rubber ball cleaning apparatus and the end cover of the refrigeration equipment are integrated, the overall dimension and installation difficulty of the whole equipment are greatly reduced, and the installation of the whole system is changed into a conventional installation of the refrigeration equipment, so that the design and installation of the rubber ball cleaning apparatus do not need to be taken into consideration any more, thereby greatly simplifying the workload of installation and saving the installation space.

In some embodiments, sections of the pipelines provided with the one-way valve A 14 and the one-way valve B 13 are designed to be horizontal, which Facilitates the opening and closing of the one-way valve A 14 and the one-way valve B 13.

The embodiments of the present disclosure have been described in detail with reference to the drawings. However, the present disclosure is not limited to the aforementioned embodiments, and various changes may be made within the knowledge of those of ordinary skill in the art without departing from the concept of the present disclosure.

What is claimed is:

1. A heat exchanger end cover integrated with a rubber ball cleaning apparatus, comprising a ball collector and a booster pump which are arranged outside the heat exchanger end cover, and a ball-receiving filter screen arranged inside the heat exchanger end cover, wherein, a cooling water inlet pipe joint and a cooling water outlet pipe joint are symmetrically arranged outside the heat exchanger end cover, with the cooling water inlet pipe joint located at a lower part, and the cooling water outlet pipe joint located at an upper part, the cooling water inlet pipe joint is provided with a water suction port and a ball-dispensing port, and the cooling water outlet pipe joint is provided with a water discharge port and a ball-receiving port;

both ends of the ball collector are respectively provided with an upper port and a lower port, a screen is arranged in the middle of an interior of the ball collector, and rubber balls are placed between the screen and the upper port;

the lower port is divided into two parts to form a first pipeline communicated with the water suction port and a second pipeline communicated with the water discharge port, the first pipeline is provided with a three-way valve A having two water inlets communicated with the first pipeline, and the second pipeline is provided with a three-way valve B having two water inlets communicated with the second pipeline, the booster pump is connected between water outlets of the three-way valve A and the three-way valve B; and the upper port is divided into two parts to form a third pipeline and a fourth pipeline, the third pipeline is provided with a one-way valve A and passes through the ball-dispensing port to extend into the cooling water inlet pipe joint, and the fourth pipeline is provided with a one-way valve B and passes through the ball-receiving port to extend into the cooling water outlet pipe joint to be communicated with the ball-receiving filter screen;

wherein the water suction port, the water discharge port and the lower port are located at a first side of the water inlet pipe joint and the cooling rater outlet pipe joint;

wherein the ball-dispensing port, the ball-receiving port and the upper port are located at a second side of the water inlet pipe joint and the cooling water outlet pipe joint, and wherein the second side is opposite to the first side;

wherein the water suction port and the ball-dispensing port are arranged in the same radial plane of the cooling water inlet pipe joint;

wherein the water discharge port and the ball-receiving port are arranged in the same radial plane of the cooling water outlet pipe joint;

wherein the ball collector is transversely arranged in a gap formed by the cooling water inlet pipe joint and the cooling water outlet pipe joint, and both the upper port and the lower port point to a radial direction of the heat exchanger end cover.

2. The heat exchanger end cover and integrated with a rubber ball cleaning apparatus of claim 1, wherein the booster pump and the ball collector are arranged side by side.

3. The heat exchange end cover integrated with a rubber ball cleaning apparatus of claim 1, wherein sections of the pipelines provided with the one-way valve A and the one-way valve B are horizontally arranged.

4. The heat exchanger end cover integrated with a rubber ball cleaning apparatus of claim 1, wherein both the three-way valve A and the three-way valve B are three-way electric valves.

* * * * *